US006499937B1

(12) United States Patent
Madison et al.

(10) Patent No.: US 6,499,937 B1
(45) Date of Patent: Dec. 31, 2002

(54) MATERIAL DISTRIBUTION SYSTEM FOR STICK-LIKE OBJECTS

(75) Inventors: Harry Madison, Mt. Pleasant, SC (US); Renee A. Neugebauer, Mitchell, SD (US)

(73) Assignee: Harsco Track Technologies, Fairmont, MN (US)

( * ) Notice: Subject to any disclaimer, the term of this patent is extended or adjusted under 35 U.S.C. 154(b) by 0 days.

(21) Appl. No.: 09/917,116

(22) Filed: Jul. 27, 2001

(51) Int. Cl.[7] ..... E01B 9/06

(52) U.S. Cl. ..... 414/787; 414/403; 414/416.03; 104/17.1

(58) Field of Search ..... 414/304, 288, 414/313, 403, 416.03, 416.07, 787; 198/514, 739, 740; 104/2, 17.1; 56/400; 209/418; 254/18; 37/316

(56) References Cited

U.S. PATENT DOCUMENTS

| | | | | |
|---|---|---|---|---|
| 3,753,404 A | | 8/1973 | Bryan, Jr. | |
| 4,538,793 A | * | 9/1985 | Dieringer et al. | 254/18 |
| 4,777,885 A | | 10/1988 | Dieringer | |
| 5,191,840 A | | 3/1993 | Cotic et al. | |
| 6,095,053 A | | 8/2000 | Johnsen et al. | |

* cited by examiner

*Primary Examiner*—Kathy Matecki
*Assistant Examiner*—Charles Fox
(74) *Attorney, Agent, or Firm*—William F. Lang IV; Eckert Seamans Cherin & Mellott, LLC

(57) ABSTRACT

A material distribution system for stick-like objects such as railroad spikes includes a rake for peeling the stick-like objects from the top of a pile, and transferring them to another location, for example, where they might be reached by a human operator. Use of the rake to peel the object from the top of the pile, with minimized downward pressure applied by the rake, minimizes the tendency of the objects to entangle with each other.

22 Claims, 3 Drawing Sheets

MATERIAL DISTRIBUTION SYSTEM FOR STICK-LIKE OBJECTS

BACKGROUND OF THE INVENTION

1. Field of the Invention

The present invention relates to material handling systems for stick-like articles, for example, railroad spikes. More specifically, the invention is a rake for moving railroad spikes from a storage location to a workstation.

2. Description of the Related Art

Railroad spikers used for assembly or repairing sections of railroad tracks typically utilize a wide variety of automatic and manual means for loading spikes into the spiker. Both automatic and manual loading methods require transport of the railroad spikes from a storage location to a location wherein they can be loaded into the spiker without causing entanglement of the spikes, and automatic spikers further require means for properly orienting the spikes and loading the properly oriented spike into the spiker.

An example of a proposed railroad spike material handling system includes a centerless auger rotating approximately 360° in the desired direction of travel for the spikes, and then backwards 45° in an attempt to untangle any tangled spikes. A vibrating storage bin may be used to feed spikes into the auger mechanism.

Another material handling system includes a horizontal conveyor leading from a spike hopper to a vertical conveyor having a plurality of projecting fingers for receiving the spikes and transporting them towards the upper portion of the spike feeder. As the spike is dropped into the spike feeder, it will strike a ridge, causing the spike to be aligned either perpendicular to the spike's direction of travel, or with the spike point facing the direction of travel. Camming walls then ensure that all spikes are oriented with the point facing the direction of travel. Once the spike is so oriented, it falls into the spike-driving assembly.

Spike material handling systems designed to vibrate, stir, tumble, or auger the spikes to the desired location typically have varying degrees of success, due to the tendency of the spikes to entangle with each other.

Yet another presently used spike distribution system includes a powered winch for lifting containers of spikes, and emptying them in a location wherein an operator may reach the spikes and load them into a spike driver.

Accordingly, a spike distribution system preventing entanglement of the spikes during transportation is desired. Additionally, a spike distribution system having greater efficiency, and not producing excessive noise, is also desired.

SUMMARY OF THE INVENTION

The present invention is a spike distribution system for delivering spikes from a storage location to a location wherein they may be reached by an operator for loading into a spiker. The spike distribution system includes a spike rake for moving the spikes from the storage location to the operator's location.

The spike rake includes a horizontally oriented rake head having a plurality of prongs on either end of the head. The prongs are dimensioned and configured to engage a spike either along its length or at the spike head. The rake is pivotally secured to an arm that may be raised or lowered to engage the spikes at the top of the storage location. An example of means for raising and lowering the arm include a hydraulic cylinder secured between the end of the arm and the shaft. The pivotal attachment of the rake permits the rake to remain horizontal due to the effects of gravity as the rake is raised and lowered and to permit the rake to pivot to correspond to the top of a pile of spikes. The arm is secured to a substantially vertical shaft that may be rotated to change the position of the rake, with an example of means for rotating the shaft being a hydraulic cylinder secured to another arm extending a short distance from the shaft.

Spikes will typically be stored in bulk behind the operator of the spike driver. The operator's workstation will typically include at least one location adjacent to the operator's seat wherein a small number of spikes may be stored within reach of the operator. A spike rake assembly will be located behind and to one side of the operator, wherein it may be used to move spikes from the storage location to the operator's work station. When additional spikes are needed at the operator's work station, the shaft may be rotated to locate the spike rake above the pile of spikes. The rake will pivot to maximize the number of prongs in contact with the spikes. The arm is then lowered to bring the spike rake into contact with the top of the pile of spikes. The shaft is then rotated to move the spike rake towards the operator's workstation while maintaining a small amount of downward pressure on the spike rake, thereby enabling the spike rake to peel some spikes from the top of the pile of spikes without causing entanglement of the spikes. Once the spike rake has reached the storage location at the operator's work station, the arm may be raised, and the spike rake again rotated towards the storage location in preparation to transfer the next set of spikes. The operator may then reach the storage location at his workstation, grab a spike, and load it into the spike driver for driving through a tie plate and railroad tie.

A preferred workstation for a spiker operator will include two small storage areas for spikes within reach of the operator, with one storage area on each side of the operator. One spike rake will be positioned to transfer spikes into each storage area, so that the operator will control a total of two spike rakes.

It is therefore an aspect of the present invention to provide a spike distribution system preventing entanglement of the spikes.

It is another aspect of the present invention to provide a spike distribution system having a high efficiency.

It is a further aspect of the present invention to provide a spike distribution system avoiding generation of excess noise.

It is another aspect of the present invention to provide a spike rake for peeling spikes from the top of a spike pile, and transferring them to a location wherein a spiker operator may reach them.

These and other aspects of the invention will become apparent through the following description and drawings.

BRIEF DESCRIPTION OF THE DRAWINGS

Like reference numbers denote like elements throughout the drawings.

DETAILED DESCRIPTION

The present invention is a material distribution system for elongated objects. The material distribution system transfers the elongated objects from a storage location, located behind an operator's seat, to a destination location, wherein the elongated objects may be reached by the operator. Although not limited to such use, the material handling system of the present invention is particularly useful for transferring railroad spikes from a storage location to a location wherein they may be reached by the operator of a spike driver, and the invention will be described herein based on this example embodiment.

Figure 1:
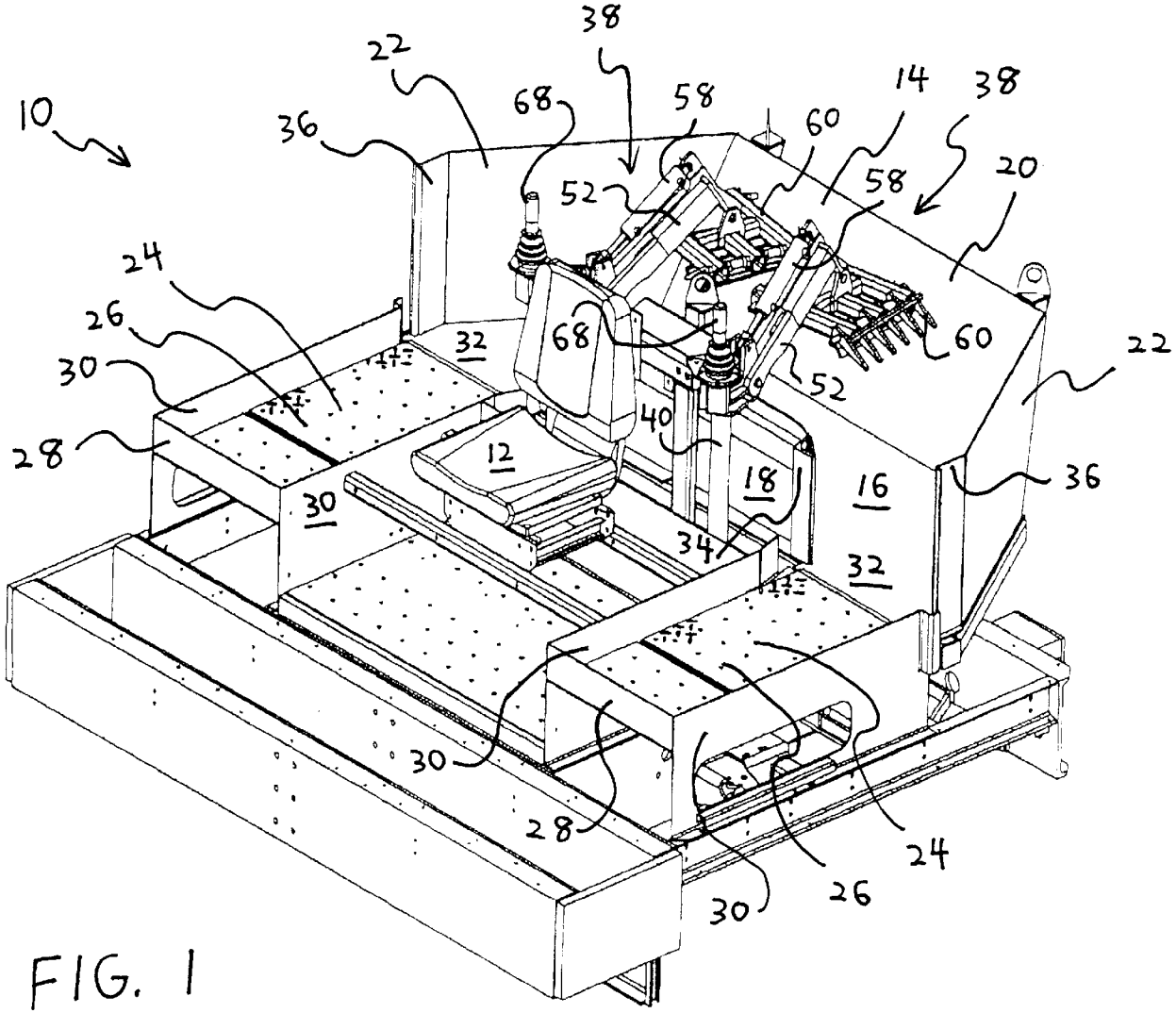
FIG. 1 is a front isometric view of a spike distribution system according to the present invention.

Referring to FIG. 1, a typical workstation for the operator of a spike driving apparatus is illustrated. The workstation 10 includes an operator's chair 12, located in a position enabling the human operator to easily reach the spike driving apparatus (not shown, and well known in the art) for loading spikes into the apparatus. A bulk storage bin 14 for the spikes is located behind the operator's chair 12. The bulk storage bin 14 includes a floor 16, front wall 18, rear wall 20, and angled side walls 22. The workstation 10 also includes at least one, and more preferably two, small operator-accessible storage bins 24, located within easy reach of the operator's chair 12. The illustrated example includes two small storage bins 24, with one bin 24 on either side of the operator's chair 12. Each bin 24 includes a floor 26, at approximately the same height or slightly lower than the floor 16 of the bulk storage bin 14. The small storage bins 24 also include front walls 28, and side walls 30. A passageway 32 is defined between the ends 34 of the spike bin's front wall 18, and the ends 36 of the bulk spike bin's side walls 22. The bulk spike bin 14 is therefore in communication with the small storage bins 24, permitting passage of spikes from the bulk spike 14 to the smaller storage bins 24. The workstation 10 also includes at least one spike rake assembly 38 for each small storage bin 24, with a preferred total number of spike rakes 38 at a workstation 10 being two.

Figure 2:
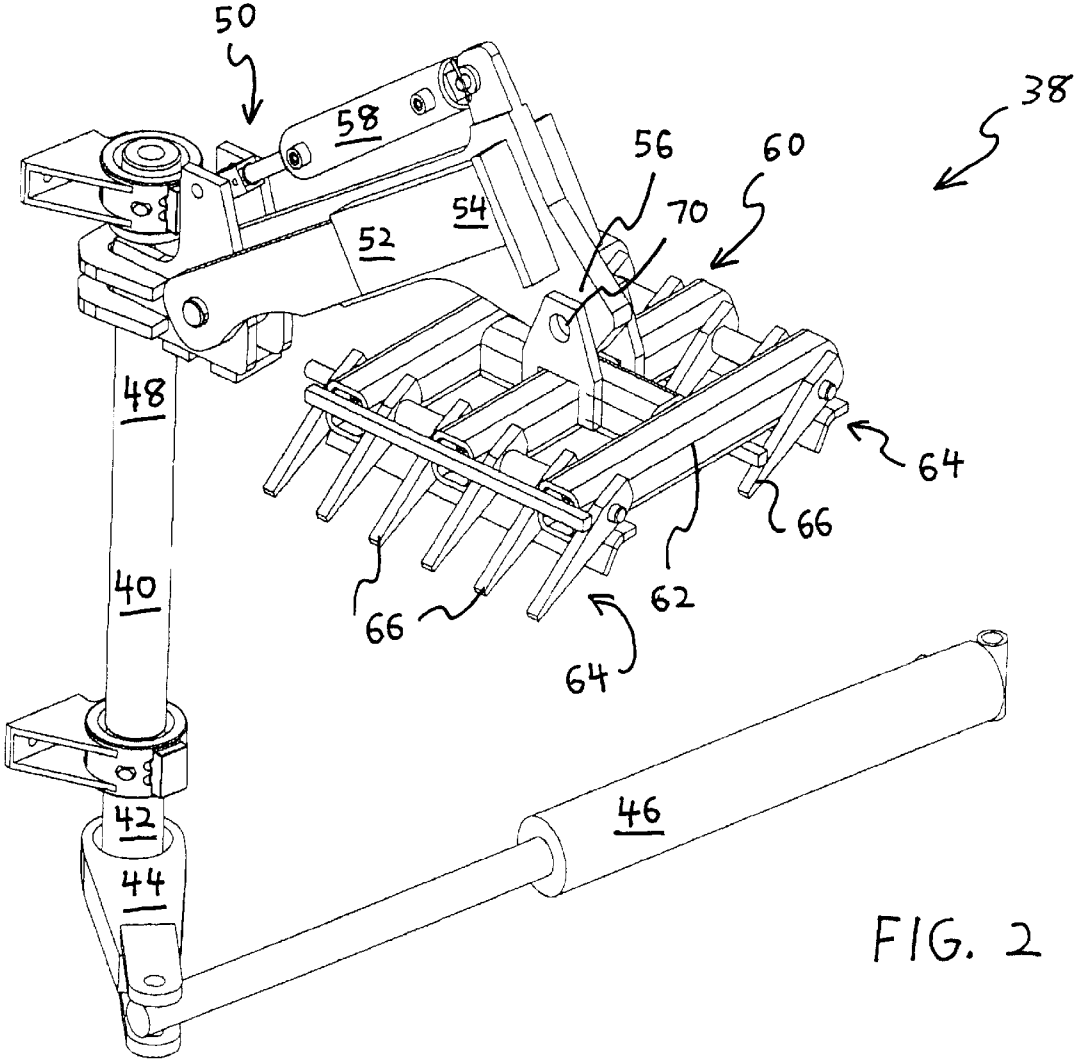
FIG. 2 is an isometric view of a spike rake assembly for a spike distribution system according to the present invention.

The spike rake assembly 38 is best illustrated in FIG. 2. The spike rake assembly 38 includes a shaft 40, rotatably mounted on the workstation 10. The shaft 40 has a lower portion 42 including an arm 44 connected between the shaft 40 and the means for rotating the shaft. The illustrated example includes a hydraulic cylinder 46 pivotally secured to the arm 44 for rotating the shaft 40. Extending the hydraulic cylinder 46 thereby rotates the shaft 40 in one direction, and retracting the hydraulic cylinder 46 rotates the shaft 40 in the opposite direction.

The top end portion 48 of the shaft 40 includes a boom assembly 50. The boom assembly 50 includes a boom 52, pivotally secured at the top portion 48 of the shaft 40, so that it may pivot within a vertical plane. The outer end 54 of the boom 52 preferably includes a downwardly extending arm 56. The boom assembly 50 also includes a hydraulic cylinder 58, extending between the top portion 48 of the shaft 40, and the outward end 54 of the boom 52. The hydraulic cylinder 58 is pivotally secured at each of these locations. Extending the hydraulic cylinder of the illustrated example lowers the boom 52, and retracting the hydraulic cylinder 58 raises the boom 52.

A spike rake is pivotally secured to the outer end 54 of the boom 52, preferably at the end of the arm 56 by the pivot 70. The spike rake 60 includes a base portion 62 and at least one set 64 of prongs 66. The illustrated example includes a horizontal, substantially planar base portion 62, having a pair of prong sets 64, with one prong set 64 located adjacent to the front of the base 62, an the other prong set 64 located adjacent to the rear of the base 62. The prongs 66 are dimensioned and configured to permit passage of the body portion of a railroad spike, but not the head portion of the railroad spike between them. The prongs 66 are preferably pointed approximately in the spike rake's direction of travel along the arcuate path between the bulk storage bin 16 and small storage bin 24 and angled downward. The pivot 70 permits the rake 60 to pivot about an axis that is substantially horizontal and substantially parallel to its direction of travel along its arced path from the bulk storage bin 14 to the operator-accessible bin 24.

Figure 3:
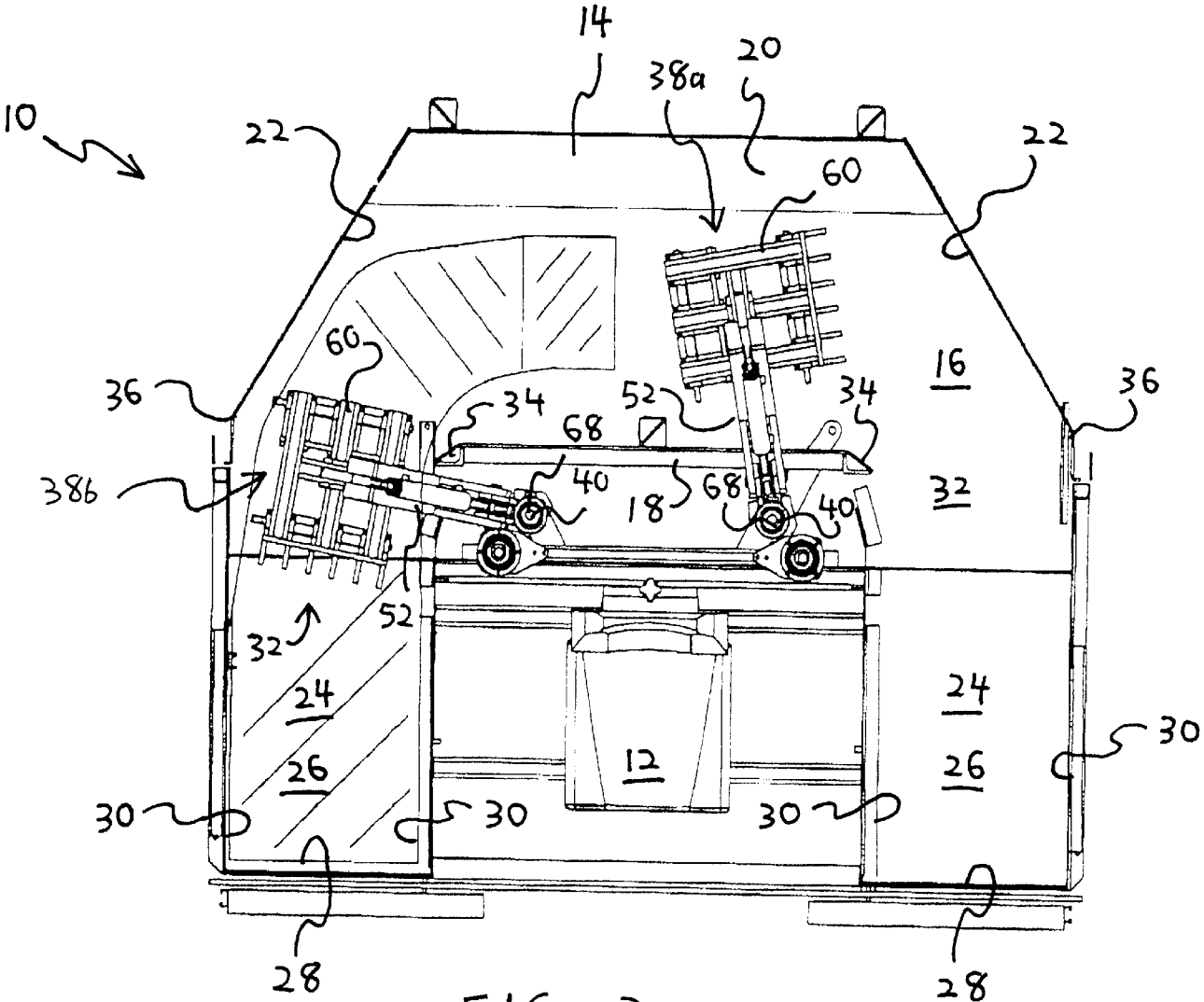
FIG. 3 is a top view of a spike distribution system according to the present invention.

Operation of the spike rake assembly 38 is best illustrated in FIGS. 3. The spike rake assembly is controlled by the joystick 68. When the human operator seated in the chair 12 wishes to move additional spikes from the bulk storage bin 14 to either of the smaller storage bins 24, the operator uses the joystick 68 to retract the hydraulic cylinder 46, thereby rotating the shaft 40 to bring the spike rake 60 to a first position (shown by rake assembly 38*a* in FIG. 3), corresponding to one end of its range of travel. The operator next uses the joystick 68 to extend the hydraulic cylinder 58, thereby lowering the spike rake 60 on top of the pile of spikes within the bin 14, and applying a small amount of downward pressure to the rake 62. The operator may control the degree of downward pressure by the extent to which he moves the joystick 68, thereby providing only the desired amount of downward pressure. While maintaining this downward pressure, the operator again manipulates the joystick 68 to extend the hydraulic cylinder 46, thereby moving the spike rake 60 from a first position above the pile of spikes in the bulk spike bin 14 to a second position above the smaller storage bin 24.

As the spike rake 60 moves from the first position to the second position (shown by rake 38*b* in FIG. 3), railroad spikes are peeled off the top of the pile by the prongs 66, catching between and in front of the prongs 66, and thereby being pushed along with the spike rake 60 towards the small storage bin 24. During this movement, the operator may choose to further extend the hydraulic cylinder 58, lowering the spike rake 60 to maintain contact with the railroad spikes as lower portions of the spike pile are encountered. Additionally, the spike rake 60 may pivot around the pivot 70 to maximize the number of prongs 66 in contact with the spikes if the spike rake 60 contacts the pile of spikes at a position wherein the spike pile is not horizontal. Once the second position has been reached, the operator may again manipulate the joystick 68 to retract the hydraulic cylinder 58, thereby raising the spike rake 60, and to retract the hydraulic cylinder 46, thereby moving the spike rake 60 to a position wherein it will be out of the way of his reaching the spikes within the small storage bin 24, and loading them into the spike driving apparatus.

While a specific embodiment of the invention has been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A material handling system for elongated objects, the elongated objects having a body portion having a first radius, and a head portion having a second radius larger than the first radius, the material handling system comprising:

a rake having a plurality of prongs, dimensioned and configured to resist passage of the head portion of the elongated objects between said prongs, and to permit passage of the body portion of the elongated objects between said prongs;

means for moving said rake between a first position and a second position, said first position and second position being selected to include a storage location for the elongated objects and a destination location for the elongated objects therebetween; and means for moving said rake upward and downward, and for applying downward pressure on said rake during movement between said first position and said second position.

2. The material handling system according to claim 1, wherein said means for moving said rake between a first position and a second position include a rotating shaft having a top portion and a bottom portion, said rake and said means for moving said rake upward and downward, and for applying downward pressure on said rake being attached to said top portion.

3. The material handling system according to claim 2, wherein said means for moving said rake between a first position and a second position include a rotating shaft having a top portion and a bottom portion having a means for rotating said shaft.

4. The material handling system according to claim 3, wherein said means for rotating said shaft include an arm extending from said bottom portion of said shaft, and a hydraulic cylinder pivotally secured to said arm at one end, and to a fixed location at its other end.

5. The material handling system according to claim 1, wherein said means for moving said rake upward and downward, and for applying downward pressure on said rake include a boom having a base end and an outward end, said base end being attached to said top portion of said rotating shaft, said rake being attached to said outward end.

6. The material handling system according to claim 5, wherein said means for moving said boom upward and downward, and for applying downward pressure to said boom, include a hydraulic cylinder having one end pivotally secured at said top portion of said shaft, and having another end pivotally secured at said outward end of said boom.

7. The material handling system according to claim 1, wherein said rake pivots around a substantially horizontal axis substantially parallel to its direction of travel.

8. The material handling system according to claim 1, wherein said rake comprises a base and at least one set of prongs.

9. The material handling system according to claim 8, wherein said at least one set of prongs is pointed approximately in a direction of travel along a path towards the destination location, and are angled downward from horizontal.

10. The material handling system according to claim 8, wherein said base is substantially planar, having a front end and a back end.

11. The material handling system according to claim 10, wherein said at least one set of prongs includes a first set of prongs at said base's front end, and a second set of prongs at said base's back end.

12. A workstation for a human operator, said workstation comprising:

an operator's chair;

at least one bulk storage bin;

at least one operator-accessible storage bin in communication with said bulk storage bin, and dimensioned and configured to be reached by a human operator seated in said operator's chair;

a material distribution system for moving elongated objects from said bulk storage bin to said operator-accessible storage bin, the elongated objects having a body portion having a first radius, and a head portion having a second radius larger than the first radius, the material handling system comprising:

a rake having a plurality of prongs, dimensioned and configured to resist passage of the head portion of the elongated objects between said prongs, and to permit passage of the body portion of the elongated objects between said prongs;

means for moving said rake between a first position and a second position, said first position and second position being selected to include said bulk storage bin and said operator-accessible storage bin therebetween; and means for moving said rake upward and downward, and for applying downward pressure on said rake during movement between said first position and said second position.

13. The workstation according to claim 12, wherein said means for moving said rake between a first position and a second position include a rotating shaft having a top portion and a bottom portion, said rake and said means for moving said rake upward and downward, and for applying downward pressure on said rake being attached to said top portion.

14. The workstation to claim 13, wherein said wherein said means for moving said rake between a first position and a second position include a rotating shaft having a top portion and a bottom portion having a means for rotating said shaft.

15. The workstation according to claim 11, wherein said means for rotating said shaft include an arm extending from said bottom portion of said shaft, and a hydraulic cylinder pivotally secured to said arm at one end, and to a fixed location at its other end.

16. The workstation according to claim 12, wherein said means for moving said rake upward and downward, and for applying downward pressure on said rake include a boom having a base end and an outward end, said base end being attached to said top portion of said rotating shaft, said rake being attached to said outward end.

17. The workstation according to claim 16, wherein said means for moving said boom upward and downward, and for applying downward pressure to said boom, include a hydraulic cylinder having one end pivotally secured at said top portion of said shaft, and having another end pivotally secured at said outward end of said boom.

18. The workstation according to claim 12, wherein said rake pivots around a substantially horizontal axis substantially parallel to its direction of travel.

19. The workstation according to claim 12, wherein said rake comprises a base and at least one set of prongs.

20. The workstation according to claim 19, wherein said at least one set of prongs is pointed approximately in a direction of travel along a path towards said operator-accessible storage bin, and are angled downward from horizontal.

21. The workstation according to claim 19, wherein said base is substantially planar, having a front end and a back end.

22. The workstation according to claim 21, wherein said at least one set of prongs includes a first set of prongs at said base's front end, and a second set of prongs at said base's back end.

* * * * *